US005557248A

United States Patent [19]

Prochazka

[11] Patent Number: 5,557,248

[45] Date of Patent: Sep. 17, 1996

[54] MAGNETIZER FOR MAGNETS WITH SHAPED MAGNETIC WAVEFORM

[75] Inventor: Vaclav Prochazka, Lake Oswego, Oreg.

[73] Assignee: Synektron Corporation, Portland, Oreg.

[21] Appl. No.: 201,189

[22] Filed: Feb. 24, 1994

[51] Int. Cl.[6] ..... H01F 7/20; H01F 13/00

[52] U.S. Cl. ..... 335/284; 361/143; 361/152; 361/153; 361/156

[58] Field of Search ..... 335/284; 361/143–156, 361/267; 310/42, 152–156

[56] References Cited

U.S. PATENT DOCUMENTS

| | | | |
|---|---|---|---|
| 3,076,111 | 1/1963 | Burgwin | 335/302 |
| 3,152,275 | 10/1964 | Aske | 335/302 |
| 3,158,797 | 11/1964 | Andrews | 335/284 |
| 3,317,872 | 5/1967 | Wullkopf | 335/284 |
| 3,335,377 | 8/1967 | Kohlhagen | 335/284 |
| 3,417,295 | 12/1968 | Littwin | 335/284 |
| 3,585,549 | 6/1971 | Muller | 335/284 |
| 3,678,436 | 7/1972 | Herdrich et al. | 335/284 |
| 4,382,244 | 5/1983 | Koester et al. | 335/284 |
| 4,458,168 | 7/1984 | Welburn | 310/185 |
| 4,575,652 | 3/1986 | Gogue | 310/49 R |
| 4,614,929 | 9/1986 | Tsukuda et al. | 335/284 |
| 4,692,646 | 9/1987 | Goteu | 310/184 |
| 4,730,230 | 3/1988 | Helfrick | 361/151 |
| 5,093,595 | 3/1992 | Korbel | 310/156 |
| 5,200,729 | 4/1993 | Soeda et al. | 335/284 |

FOREIGN PATENT DOCUMENTS

| | | |
|---|---|---|
| 58-62711 | 4/1983 | Japan . |
| 60-169114 | 1/1986 | Japan . |
| 63-69449 | 8/1988 | Japan . |

OTHER PUBLICATIONS

A. Cassat et al., "Permanent Magnets Used in Brushless DC Motors: The Influence of the Method of Magnetization" pp. 109–122.

J. Stupak et al., "Fixtures For Straight–Through Magnetizing" pp. 123–129.

*Primary Examiner*—Leo P. Picard
*Assistant Examiner*—Raymond M. Barrera
*Attorney, Agent, or Firm*—Chernoff, Vilhauer, McClung & Stenzel

[57] ABSTRACT

An apparatus for making permanent magnet material magnetizes a body of material including a primary winding which has portions wound on a first core carrying current in a first direction creating a first field of flux and a secondary winding having portions wound on a second core wherein the secondary winding carries current in a second opposing direction to create a second field of flux. Since the currents are flowing in opposing directions, the secondary field of flux is directed to oppose the first field of flux. The result of this is that the magnetizer is capable of controlling the width of the pole to pole transition region for matching the stator geometry and thereby nearly eliminating cogging torque and reducing ripple torque.

10 Claims, 5 Drawing Sheets

MAGNETIZER FOR MAGNETS WITH SHAPED MAGNETIC WAVEFORM

BACKGROUND OF THE INVENTION

This invention relates to a method and apparatus for magnetizing material, and more particularly, to an apparatus and method for magnetizing material in such a manner that the magnetic pole transitions are custom-shaped.

Direct current brushless motors and other electrical devices employ an annular shaped article of magnetized material having a relatively thin wall thickness, which is generally referred to as a ring magnet. Ring magnets can be composed of any suitable material, such as, $SmCo_5$, Alnico, barium ferrite or a plastic NdFeB. To create magnetized areas of alternating north and south magnetic poles on a ring magnet (including transition regions of no magnetization between each adjacent north and south magnetic pole) magnetizers of various configurations are employed.

The distribution of the magnetic poles and transition regions on the ring magnet have a direct effect on motor performance due to the spatial distribution of the permanent magnetic flux fields interacting with the stator and stator windings of the motor.

The spatial distribution of these permanent magnetic flux fields affects the amount of cogging torque $[{}^{dRm}/_{d\alpha}]$ of a brushless motor. This is an undesirable torque that is directly proportional to the change of the magnetic reluctance $R_m$ (the reluctance through the stator seen by the magnetic pole's permanent magnetic flux fields of the ring magnet) with respect to the rotor position $\alpha°$. If the width of the magnetic poles and transition regions do not match the stator geometry, then the magnetic reluctance $R_m$ seen by the magnetic poles will change with different rotor positions $\alpha°$ $({}^{dRm}/_{d\alpha}\neq 0)$, causing the rotor to cog. This cogging torque is a major parasitic component in the output motor torque, thereby increasing noise and vibration and decreasing motor efficiency. Conversely, if the width of the magnetic poles and transition regions can be effectively controlled to match the stator geometry, then the magnetic reluctance $R_m$ seen by the magnetic poles will remain constant at different rotor positions $\alpha°$ $({}^{dRm}/_{d\alpha}\neq 0)$, thereby causing the motor to run more smoothly.

The internal torque generated by interaction of a winding current and the permanent magnetic flux fields of a brushless motor is not a constant torque in practical motor applications. The internal torque is directly proportional to the product of the back EMF generated by the motor and the current generated by the power supply, which both have a direct effect on the amount of the variation in the internal torque, referred to as a ripple torque. In turn, the back EMF is directly proportional to the permanent magnetic flux fields. Therefore, by controlling the spatial distribution of the permanent magnetic flux fields the back EMF has a direct impact on the ripple torque. The present inventor has discovered that changing the transition regions between the magnetic poles by changing the impedance in the circuit of the magnetizer, and by reducing or increasing the current in the secondary winding of the magnetizer, can change the back EMF wave-shape. One such example is to optimize the back EMF wave-shape to a flat square wave-shape or to a sinusoidal wave-shape for reducing the ripple torque depending upon the motor power supply used.

Tsukuda, U.S. Pat. No. 4,614,929, discloses a method for the magnetization of an annular magnet by placing a magnetic core on opposing sides of an annular magnet. Magnetizing members of each core are spaced-apart circumferentially in conformity with the shape of the annular material and are opposed perpendicularly to each other across the annular material. Energizing the magnetic members on each magnetic core creates magnetic flux fields which are mutually reinforcing, thereby creating magnetized regions of alternating polarity on the annular magnet. This mutual reinforcement makes it difficult to control the width of the transition regions between adjacent magnetic flux fields. Further, because of oversaturation of the magnetic cores, the magnetic flux fields are not confined to regions within the magnetic poles; therefore, leakage occurs through the slots making control of the width of the transition region even more difficult.

A. K. Littwin, U.S. Pat. No. 3,417,295, discloses a magnetizer for magnetizing certain cup-type units used in generators and motors. The magnetizer includes an outer casing having a surrounding wall and one or more magnets on the inner surface of the wall. The magnetizer has pole elements on the outside and magnetizing heads on the inside which are mutually opposed as to polarity, thus establishing an intense flux through the magnet material. With the mutually opposed polarity, the resulting magnetic flux fields reinforce each other making the width of the transition region between adjacent poles difficult to control.

Other magnetizers are shown in the following U.S. Pat. Nos: 5,093,595, 3,678,436, 3,335,377, 4,575,652, 3,585,549, 4,692,646, 3,158,797, and 3,317,872, but none provide any capability for controlling the width of the transition area between adjacent poles of an annular magnetically permeable material.

SUMMARY OF THE INVENTION

The present invention overcomes the foregoing drawbacks by providing a magnetizer for magnetizing a body of material which is capable of controlling the width of the pole to pole transition region. The magnetizer includes a primary winding which has portions wound about a first core, carrying current in a first direction to create a first field of flux associated with the primary winding, and a secondary winding having portions wound around a second core, wherein the secondary winding carries current in a second opposing direction to create a second field of flux associated with the secondary winding. Since the currents are flowing in opposing directions, the secondary field of flux is directed to oppose the first field of flux. The first core and second core are respectively positioned to permit the insertion of a material to be permanently magnetized.

With opposing first and second fields of flux, the second field of flux will cancel portions of the first field of flux, allowing for the shaping of the resultant magnetic field. By cancelling portions of the first field of flux with the second field, a transition region may be formed where no resultant magnetic flux fields pass through the material. On both sides of the transition region the first flux field will pass through the material creating pole regions of opposite polarity. By increasing or decreasing the magnitude of the second field of flux, the width of the transition region may be respectively increased or decreased. With the proper width of the transition region and spacing of the magnetic poles, cogging torque can be nearly eliminated and ripple torque can be reduced as previously described.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
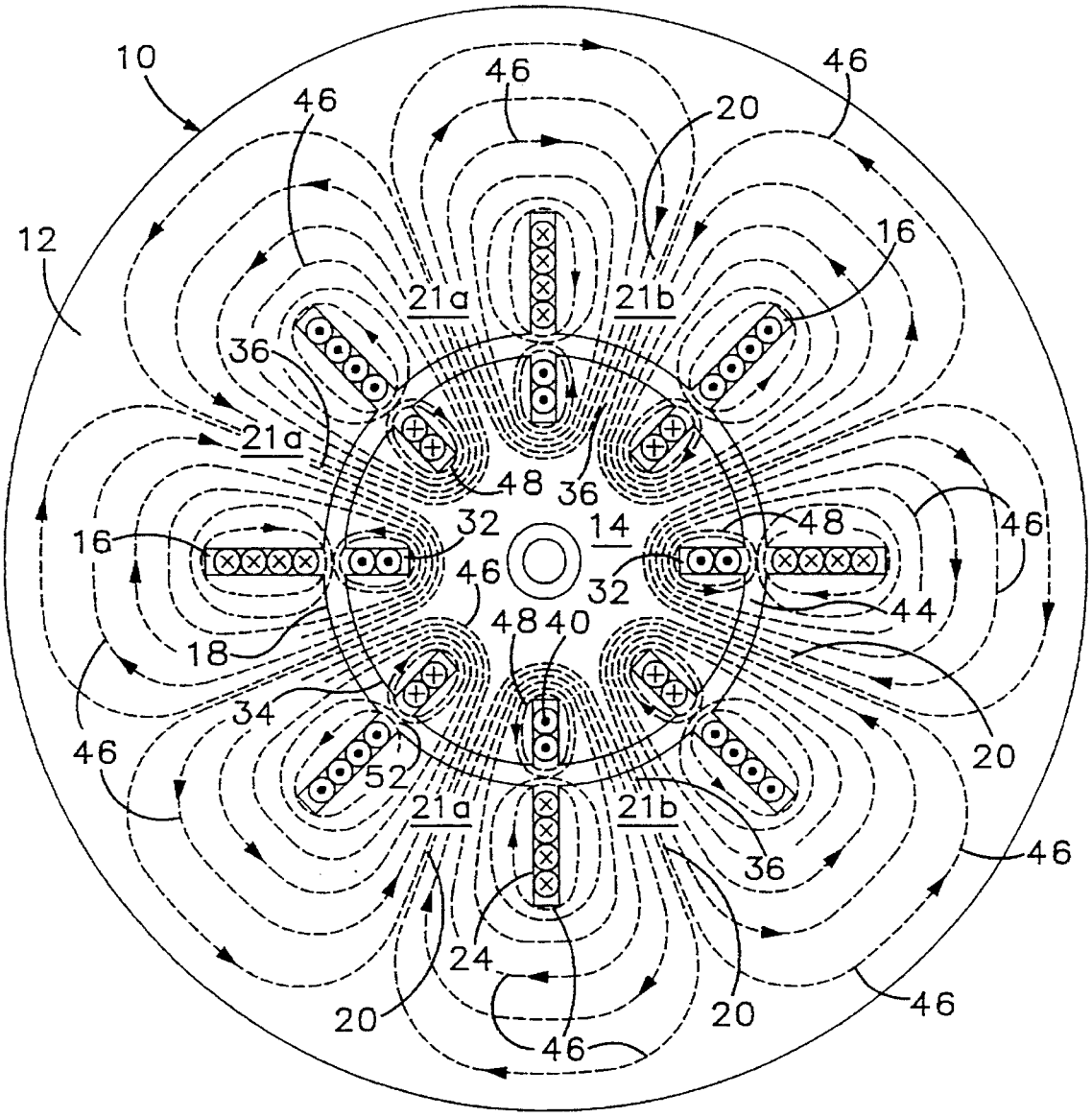
FIG. 1 is a cross section of a magnetizer, with representations of the magnetic flux fields shown by dashed lines.

FIG. 1 shows an exemplary embodiment of a magnetizer 10 designed in accordance with the present invention. The magnetizer 10 comprises an outside core 12 and an inside core 14, both of which are designed to carry magnetic flux. The outside core 12 is preferably constructed using mutually insulated laminations stacked up and bonded together with varnish in a conventional manner. Alternatively, the outside core 12 could be machined of a solid magnetic material or nonmagnetic material, constructed of stacked-up laminations which are not insulated from each other or could be constructed according to any other suitable method. The outside core 12 defines two or more radial slots 16 that extend through the outside core 12 and extend outward from the inside cylindrical surface 18. Each pair of adjacent radial slots 16 defines a magnetizing pole 20 therebetween. The outer core 12 has a primary winding 22 (FIG. 2) which is preferably an insulated copper wire, that is wrapped by weaving the wire through the radial slots 16 in any conventional manner, but ensuring that the direction of the primary winding 22 around each individual pole 20 is the same, and that the direction of the primary winding 22 around adjacent poles is in an opposite direction. In other words, a current flowing through the primary winding 22 should flow in only one direction within any particular radial slot 16 and the current should flow in opposite directions in adjacent radial slots 16.

To form the primary winding 22, any appropriate winding scheme can be employed, such as weaving the wire down one radial slot 16, up the adjacent radial slot 16, down the next adjacent radial slot 16, and so forth, until all the radial slots 16 of the outside core 14 have the appropriate number of wraps to provide the desired magnetic flux upon excitation of the primary winding 22 with an electric current.

Alternatively, the primary winding 22 could be formed by winding a single pole 20 with an appropriate number of wraps in one direction, then winding the adjacent pole 20 in the opposite direction and so forth until all the poles 20 of the outside core 12 are wrapped.

With the adjacent poles wound in opposite directions a current imposed on the primary winding 22 creates north poles 21*a* and south poles 21*b* of magnetic flux. Preferably, the outside core 12 is designed with an even number of radial slots 16 positioned at equidistant, spaced-apart locations around the outside core 12 so that the north poles 21*a* and south poles 21*b* alternate around the outside core 12 and no adjacent poles 20 will have the same polarity.

An inside core 14 is constructed in the same manner as the outside core 12. The inside core 14 defines the same number of radial slots 32 as the outside core 12 that extend through the inside core 14 and extend inward from the outside cylindrical surface 34. Each pair of adjacent radial slots 32 defines a magnetizing pole 36 therebetween. The inside core 14, as with the outside core 12, has an even number of radial slots 32 located at equidistance spaced-apart locations around the inside core 14 and is wound with a wire to form a secondary winding 38 by weaving the wire down one radial slot 32, up the adjacent radial slot 32, down the next radial slot 32, and so forth until all the radial slots 32 of the inside core 14 have the appropriate number of wraps. The secondary winding 38 is wrapped such that when current is imposed on the secondary winding 38 the radial magnetic flux fields 48 created by the secondary winding 38 opposes the radial magnetic flux fields 46 created by the primary winding 22. The direction of the current in the primary and secondary windings 22 and 38 that is necessary to create opposing primary and secondary flux fields 46 and 48 is illustrated by current flowing down into the plane of the paper in a portion of the wire 24 (shown as an encircled "x") creating a primary flux field 46 with a clockwise direction, and up out of the plane of the paper in a portion of the wire 40 in the secondary winding 38 of a complimentary radial slot 32 (shown as an encircled dot) creating a secondary flux field 48 with a counterclockwise direction. Each radial slot 16 is aligned with a respective radial slot 32 so that all the magnetizing poles 20, 36 are grouped as complementary pairs.

Figure 2A:
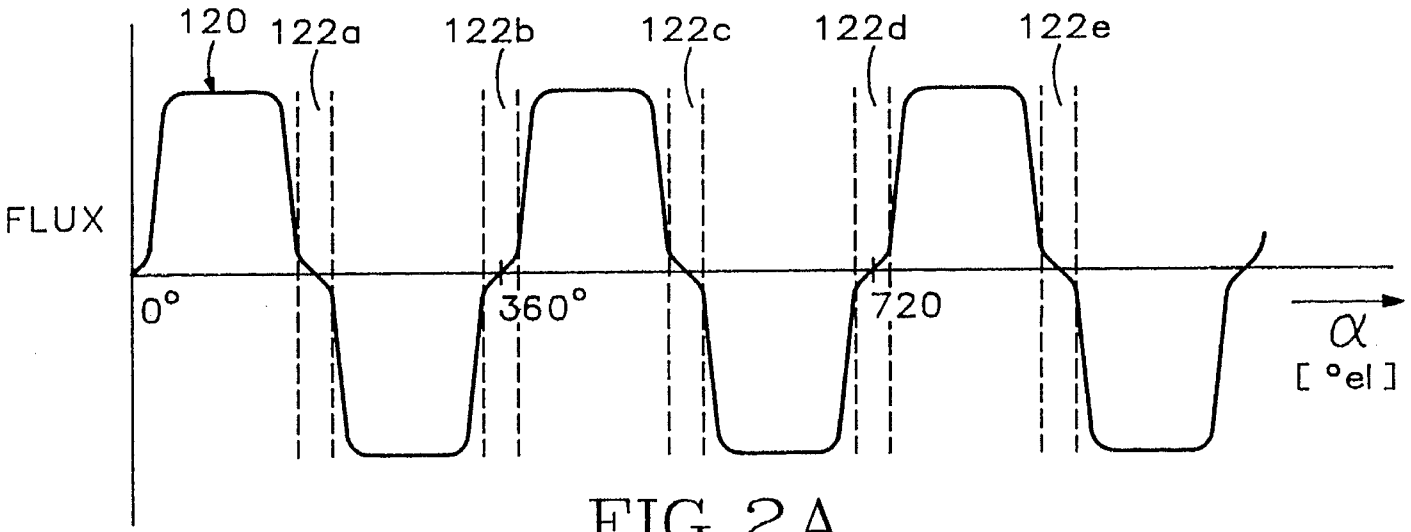
FIG. 2A is a pictorial representation of a magnetic waveform produced in a conventional fashion.

FIG. 2A shows the shape of a magnetic waveform 120 versus angle α (measured in electrical degrees) produced in a conventional magnetizer. The transition zones 122*a–e* where the magnetic flux is changing polarity are narrow and abrupt.

Figure 2B:
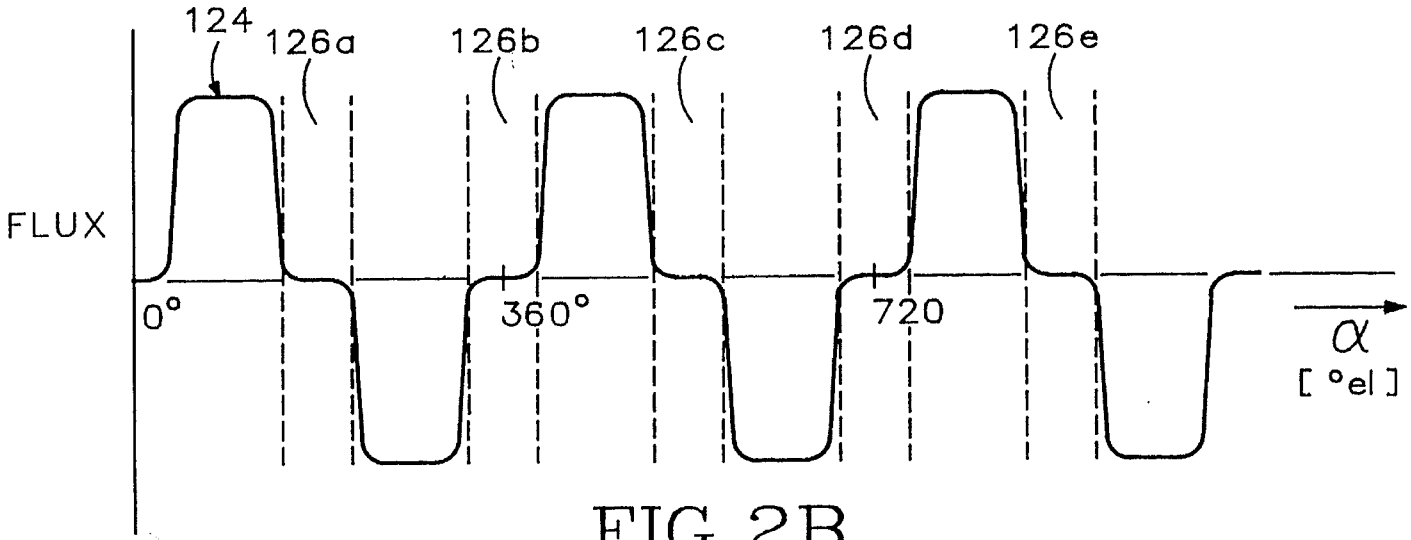
FIG. 2B is a pictorial representation of a magnetic waveform produced in accordance with the present invention.
Figure 3:
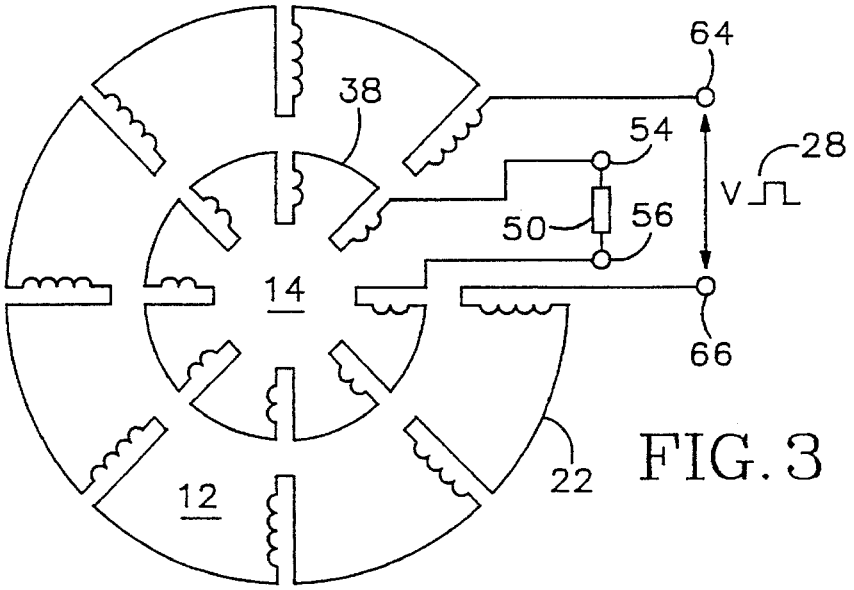
FIG. 3 is a schematic circuit diagram of the magnetizer shown in FIG. 1.
Figure 4:
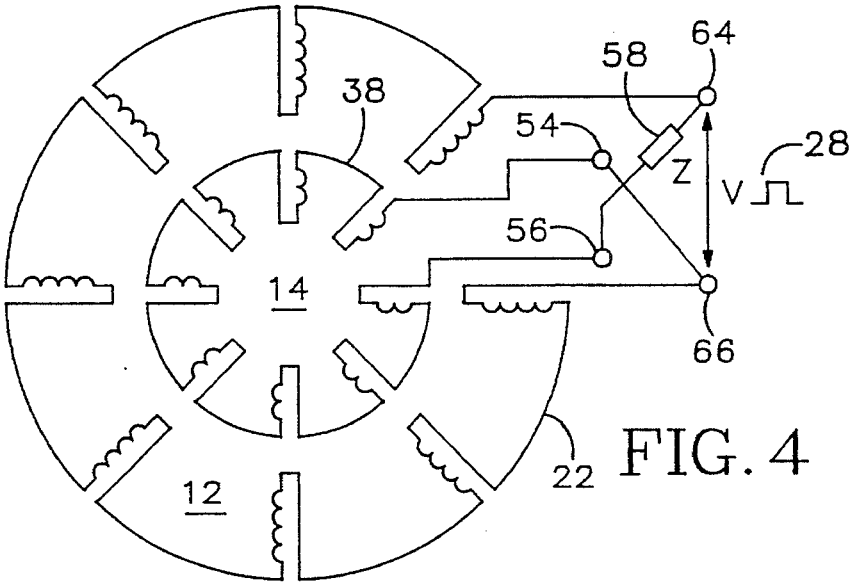
FIG. 4 is a schematic circuit diagram of an alternative embodiment of the invention.

FIG. 2B shows the shape of a magnetic flux waveform 124 versus angle α (measured in electrical degrees) produced in an adjustable magnetizer of the present invention. The width of the transition zones 126*a–e* where the magnetic flux is changing polarity are wider than the transition zones 122*a–e*. The width of the transition zones 126*a–e* can be easily adjusted using different values of the impedance 50 or 58 (FIGS. 3 and 4). This permits the magnetic waveform to be easily tuned up to a stator geometry and desired back EMF wave-shape when the permanent magnet is employed in a particular motor application.

Referring to FIG. 3, the terminals 64, 66 of the primary winding 22 are connected to an external magnet charger (not shown) which generates an electrical magnetizing pulse 28. The terminals 54, 56 of the secondary winding are connected to an external impedance 50 which can be varied from 0 ohms (short circuit) to a high value (hundreds of ohms).

An annular shaped permanent magnet material with a thin wall surface, generally known as a ring magnet, is inserted into the gap 44 between the inside cylindrical surface 18 of the outside core 12 and the outside cylindrical surface 34 of the inside core 14 and is held in place by a support apparatus (not shown). An electrical magnetizing pulse 28 is applied to the terminals 64, 66 which creates primary magnetic flux fields 46 centered around each radial slot 16. The current flowing in the portions of the primary winding 22 contained within the radial slots 16 provides the major component of the primary flux fields 46. The portions of the primary winding 22 that are outside the radial slots 16 do not contribute significantly to the primary flux fields 46, and the primary flux fields 46 created between two adjacent radial slots 16 reinforce each other in an area near the central portion of each pole 20. The directions of the resultant primary flux fields 46 of adjacent poles 20 have alternating polarities forming north poles 21*a* and south poles 21*b*.

The primary flux fields 46 from the primary winding 22 link magnetically to the secondary winding 38, inducing a proportional secondary internal voltage. The secondary internal voltage causes a current to flow in the secondary winding 38 in a direction opposite to the current in the primary winding 22. Accordingly, a current in the primary winding 22 illustrated as flowing down into the page or up out of the page of a particular radial slot 16 will respectively induce a current flowing up out of the page or down into the page in the corresponding radial slot 32. The current in the secondary winding 38 creates secondary magnetic flux fields 48, having a direction that opposes the direction of the respective primary flux fields 46. The primary flux fields 46 and secondary flux fields 48 will superimpose and result in a final radial magnetizing flux. The resulting radial magnetizing flux is significantly stronger at the center 36 of the poles 20, thus achieving full magnetization at this region. Flux fields 46 decrease in radial direction with the increasing significance of the secondary flux fields 48 towards the transition regions 52 or edges of each pole 20. In other words, the weakening effect of the radial primary flux fields 46 caused by the secondary flux fields 48 is significant only close to the radial slots 16 and 32 where the resultant radial magnetizing flux will be pushed towards the center of the magnetized regions and it will be weakened, shaped, and deflected into a tangential direction at the pole transition regions 52.

The magnitude of the secondary flux fields 48 is proportional to the current in the secondary winding 38 which in turn depends on value of the impedance 50 connected to the terminals 54, 56. The secondary flux fields 48 and their shaping effect on the primary flux fields 46 may be regulated by using different values for the impedance 50. Increasing the value of the impedance 50 will decrease the secondary current making the transition regions 52 between adjacent poles become narrower. In contrast, decreasing the value for the impedance 50 will increase the secondary current, widening the transition regions 52 between adjacent poles. By controlling the value for the impedance 50, the final radial magnetizing flux may be shaped, thereby permitting easy adjustment of the width of the transition regions 52 for minimizing motor cogging torque and maximizing the motor performance.

Referring to FIG. 4, an alternative embodiment is shown with the terminals 54, 56 of the secondary winding 38 electrically connected to terminals 64, 66 of the primary winding 22. The terminal 54 is electrically connected to the terminal 66 and the terminal 56 is coupled to an impedance 58 which is in turn electrically connected to the terminal 64. This terminal connection scheme places the primary winding 22 in parallel with the secondary winding 38, and the secondary winding 38 in series with the impedance 58. The secondary winding 38 should be wrapped in the opposite direction from the primary winding 22 to create opposing primary and secondary flux fields. In other words, a current imposed from the same electrical magnetizing pulse 28 should flow in opposing directions in complimentary radial slots 16 and 32. The value of the impedance 58 may be varied to select the desired magnitude of the secondary flux fields 48 for shaping the transition regions 52.

Figure 5:
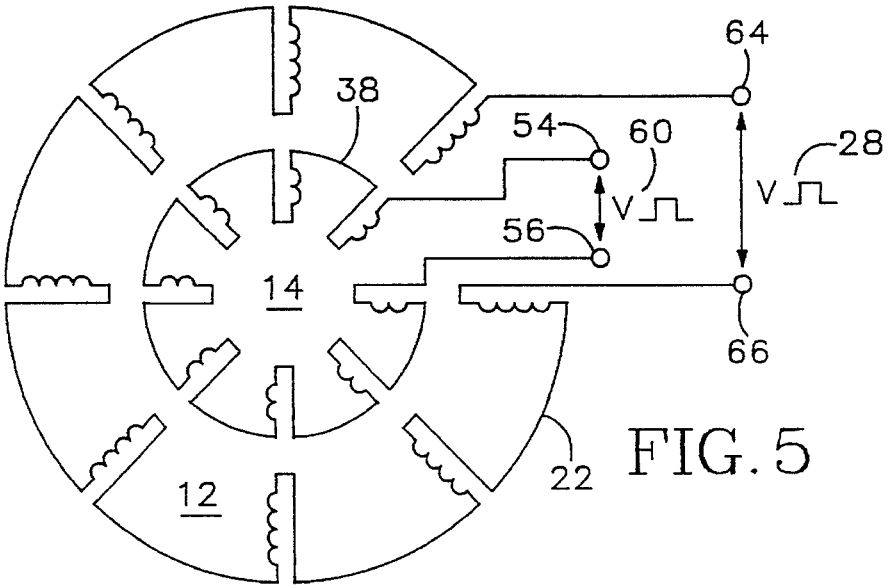
FIG. 5 is a schematic circuit diagram of another alternative embodiment of the invention.

Referring to FIG. 5, another alternative embodiment is shown using separate electrical magnetizing pulses 28 and 60 for the primary and secondary windings 22 and 38, respectively. If both electrical magnetizing pulses 28 and 60 have the same polarity, secondary windings are wound such that current flows in opposite directions in respective pairs of radial slots 16 and 32 to create opposing primary and secondary flux fields 46, 48. Alternatively, if the primary and secondary windings are wound such that current flows in the same direction in respective pairs of radial slots 16 and 32 then the electrical magnetizing pulses 28 and 60 should have opposing polarity to create primary and secondary flux fields 46 and 48 that oppose each other. With either winding scheme the magnitude of one of the electrical magnetizing pulses 28 and 60 should be smaller than the other to permit shaping of the resultant magnetic flux fields.

Figure 6:
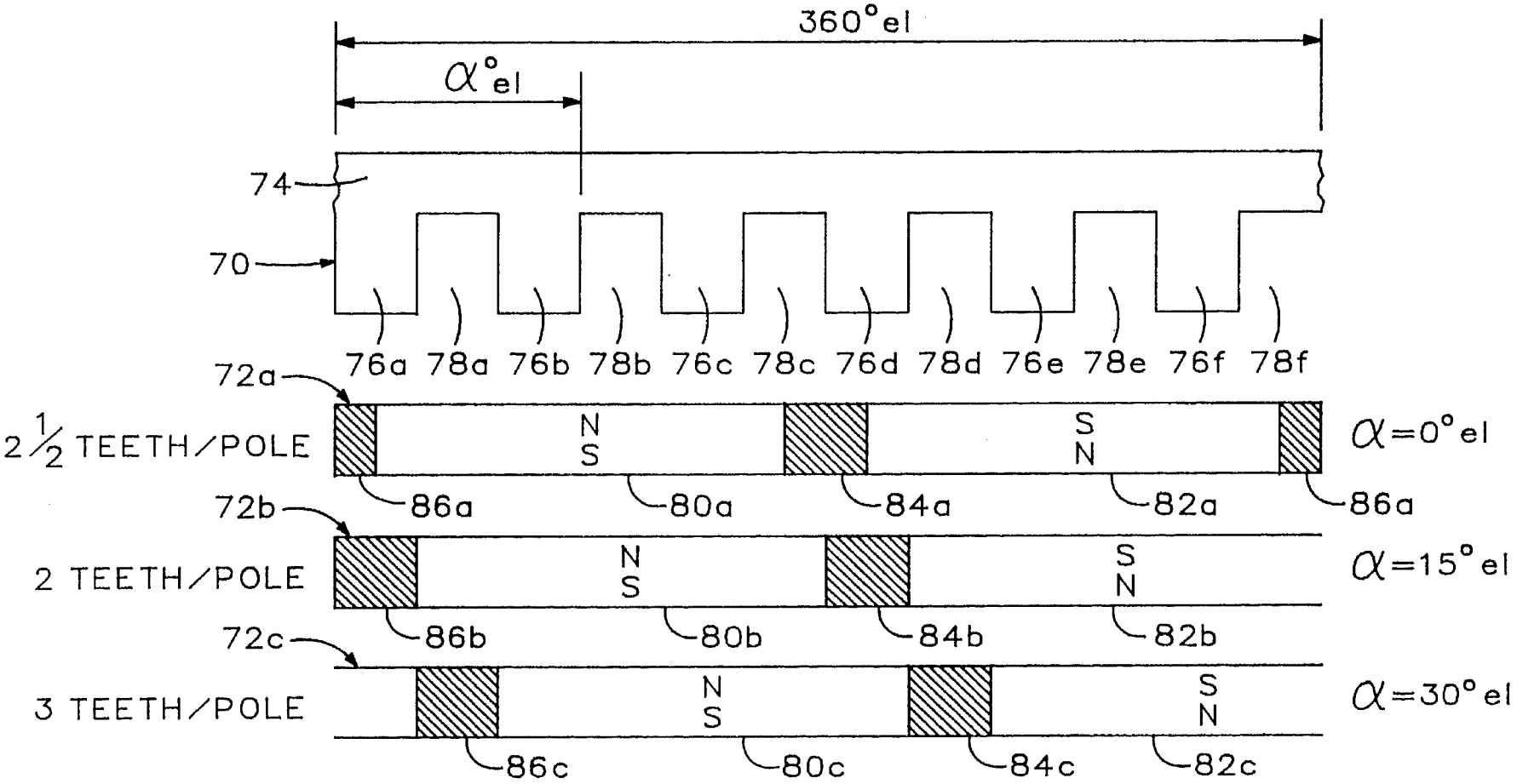
FIG. 6 is a pictorial representation of an annular magnet magnetized in a conventional fashion, shown at three different angular rotations α, and a stator of a motor, all projected onto a linear reference plane for clarity.

Referring to FIG. 6 a stator 70 is shown above three views of an annular magnet 72*a*, 72*b*, or 72*c* at different angular rotations (α°) which has been magnetized without using opposing secondary flux fields. An annular stator back iron 74 with six stator teeth 76*a*–76*f* and six slots 78*a*–78*f* is projected onto a linear reference plane. The angular rotation (α°) is referenced from 0° at the left side of the stator tooth 76*a* and increases to the right by 360°, representing one full revolution around the stator 70. The same annular magnet 72*a*, 72*b*, and 72*c* is shown projected onto a linear reference plane at three different angular rotations, 72*a* α=0°, 72*b* α=15°, and 72*c* α=30°. The annular magnet 72*a* is shown with two magnetized regions 80*a* and 82*a*, each of opposite polarity, and two transition regions 84*a* and 86*a*. Magnetized region 80*a* directly faces 2½ stator teeth 76*b*, 76*c* and ½ of tooth 76*a*, which is the major component effecting the magnetic reluctance ($R_m$) seen by the magnetized region 80*a*. After rotation of the annular magnet 72*b* to the right 15° (α=15°) the magnetized region 80*b* only directly faces two stator teeth 76*b* and 76*c*. After rotation of the annular magnet 72*c* by 15 more degrees (α=30°) then the magnetized region 80*c* directly opposes three stator teeth 76*b*, 76*c* and 76*d*. Consequently, the number of stator teeth opposed by the permanent magnetic flux of the magnetized region 80*a*–80*c*, and likewise, by the magnetized region 82*a*–82*c*, changes with the rotor position (α°). Therefore, the reluctance ($R_m$) opposing the permanent magnet flux is changing with rotor position α° where $^{dRm}/_{d\alpha}\neq 0$. The changing magnetic reluctance with rotor position causes significant unwanted parasitic cogging torque which reduces motor performance.

Figure 7:
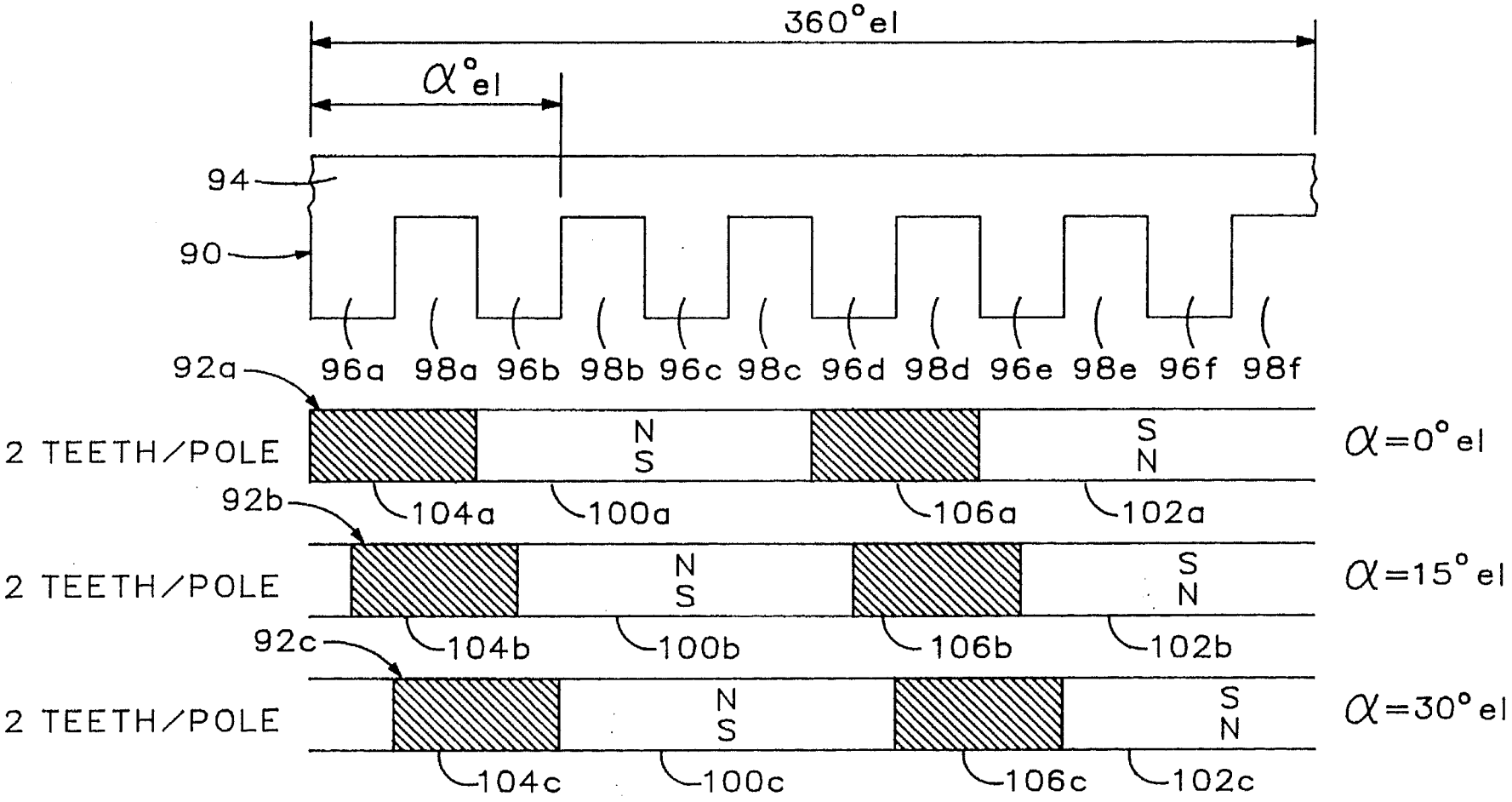
FIG. 7 is a pictorial representation of an annular magnet magnetized in accordance with the present invention, shown at three different angular rotations α and a stator of a motor, all projected onto a linear reference plane for clarity.

FIG. 7, which shows the effect of the adjustable magnetizer of the present invention, shows that the apparatus magnetizes magnets in a manner that minimizes the cogging torque. A stator 90 is shown above three views of the same annular magnet 92*a*, 92*b*, 92*c* which has been magnetized in accordance with the present invention at different angular rotations (α°). An annular stator back iron 94 with six stator teeth 96*a*–96*f* and six slots 98*a*–98*f* is projected onto a linear reference plane. The angular rotation (α°) is reference from 0° at the left side of the stator tooth 96*a* and increases to the right by 360°, representing one full revolution around the stator 90. The same annular magnet 92*a*, 92*b*, 92*c* is shown projected onto a linear reference plane at three different angular rotations, 92*a* α=0°, 92*b* α=15°, and 92*c* α=30°. The annular magnet 92*a* is shown with two magnetized regions 100*a* and 102*a*, each of opposite polarity, and two transition regions 104*a* and 106*a*. The magnetized regions 100*a* and 102*a* are the same size and are magnetized by the primary flux fields 46 directed through the poles 20 of the magnetizer 10. The transition regions 104*a* and 106*a* on the annular magnet 92*a* are formed by the transition regions 52 of the magnetizer 10. The magnetized region 100*a* directly faces two stator teeth 96*b* and 96*c* which is the major component affecting the magnetic reluctance ($R_m$) seen by the magnetized region 100*a*. After rotation of the annular magnet 92*b* to the right 15° ($\alpha$=15°) the magnetized region 100*b* still directly opposes a total of two stator teeth, ½ of tooth 96*b*, 96*c*, and ½ of tooth 96*d*. After further rotation of the annular magnet 92*c* by 15 more degrees ($\alpha$=30°) the magnetized region 100*c* still directly opposes two stator teeth 96*c* and 96*d*. The magnetizer can easily be adjusted to vary the width of the transition regions 52 of the magnetizer, in any manner previously described, which corresponds to the transition regions 104*a–c* and 106*a–c* on the annular magnet 92*a–*92*c* for matching the particular stator geometry. If the stator geometry changes (primarily the number and width of the stator teeth 96*a–f* and stator slots 98*a–f*), it is apparent that the same magnetizer could be used to magnetize an annular magnet 92*a–c* with a different number of poles and different width of the transition regions 104*a–c* and 106*a–c* to match the new stator.

Accordingly, the rotor of the motor, with an attached annular magnet rotating about a slotted stator 90, has the magnetic flux per pole 100*a–c* and 102*a–c*, each opposing a total of two stator teeth 96*a–f* at any rotor position $\alpha$=0° to $\alpha$=360°. Since the magnetized regions 100*a–c* and 102*a–c* oppose the same number of stator teeth 96*a–f* at any rotor position the magnetic reluctance ($R_m$) seen by each magnetized region 100*a–c* and 102*a–c* remains constant with any rotor position eliminating any parasitic cogging torque ($^{dRm}/_{d\alpha}$=0). Although the cogging torque cannot be eliminated entirely, it will be greatly reduced with the apparatus described above.

Further, the permanent magnetic flux fields of the magnetized regions 100*a–c* and 102*a–c* generates optimized back EMF wave-shapes, which in turn with the current from the motor power supply generates torque with a reduced ripple. Hence, with custom-shaped magnetized regions to match the stator geometry a reduction in the ripple torque is achieved.

Other methods can be used to create and modify the secondary flux fields that oppose the primary flux fields. The number of windings of the secondary winding around the poles may be increased or decreased, respectively, to increase or decrease the secondary flux fields.

It is understood that the inside core could alternatively be the primary and the outside core could be the secondary without affecting the functionality of the magnetizer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A magnetizer for magnetizing a body of material having an annular shape comprising:

(a) a primary winding having portions wound about a first core, said primary winding being distributed at spaced-apart locations adjacent an inner periphery of said body of material;

(b) said primary winding carrying current in a first direction so as to create a first field of flux associated therewith;

(c) a secondary winding having portions wound around a second core, said secondary winding being distributed at spaced apart locations adjacent an outer periphery of said body of material;

(d) said secondary winding carrying current in a second direction so as to create a second field of flux associated therewith, said second field being directed so as to oppose said first field;

wherein said first core and said second core are respectively positioned to magnetize a material disposed therebetween.

2. The magnetizer of claim 1 wherein the direction of current in the primary windings at said locations is opposite the direction of current in the secondary windings.

3. The magnetizer of claim 1 wherein said secondary winding includes terminals and has a variable impedance attached at said terminals of said secondary winding.

4. A method for the manufacture of an annular magnet made from magnetically permeable material, comprising:

(a) positioning said magnetically permeable material between a first core having a primary winding that is distributed at spaced-apart locations adjacent an inner periphery of said material and a second core with a secondary winding that is distributed at spaced-apart locations adjacent an outer periphery of said material;

(b) creating a first field of flux by a first current flowing in said primary winding; and (c) creating a second field of flux by a second current flowing in said secondary winding that opposes said first field of flux.

5. The method of claim 1 further including the step of placing a variable impedance in series with first and second terminals of said secondary winding prior to executing steps (b) and (c).

6. A magnetizer for magnetizing a body of material comprising:

(a) a primary winding having portions wound about a first core, said primary winding carrying current in a first direction so as to create a first field of flux associated therewith;

(b) a secondary winding having portions wound around a second core, said secondary winding carrying current in a second direction so as to create a second field of flux associated therewith and including an impedance coupled to said secondary winding, the value of said impedance determining in part the amplitude of said current in said secondary winding, the second field of flux being directed so as to oppose said first field;

wherein said body of material is placed between said primary winding and said secondary winding to be magnetized thereby.

7. The magnetizer of claim 6 wherein said body of material has an annular shape and said primary winding is distributed at spaced-apart locations adjacent an inner periphery of said body of material on said first core, and secondary winding is distributed at spaced apart locations adjacent an outer periphery of said body of material on said second core.

8. The magnetizer of claim 7 wherein the direction of current in said primary winding is opposite to the direction of current in said secondary winding.

9. The magnetizer of claim 6 wherein said impedance is detachably coupled to said secondary winding.

10. The magnetizer of claim 6 wherein said impedance is a variable impedance.

* * * * *